US009308573B2

(12) United States Patent
Wiedner

(10) Patent No.: US 9,308,573 B2
(45) Date of Patent: Apr. 12, 2016

(54) ROLLER FORMING DEVICE FOR FORMING A LINEAR METAL MATERIAL

(75) Inventor: Christoph Wiedner, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 1072 days.

(21) Appl. No.: 13/414,505

(22) Filed: Mar. 7, 2012

(65) Prior Publication Data

US 2012/0234064 A1 Sep. 20, 2012

(30) Foreign Application Priority Data

Mar. 11, 2011 (DE) ..... 10 2011 005 401

(51) Int. Cl.
*B21H 8/00* (2006.01)
*B21H 8/02* (2006.01)
*B21D 17/04* (2006.01)

(52) U.S. Cl.
CPC *B21H 8/00* (2013.01); *B21D 17/04* (2013.01); *B21H 8/02* (2013.01)

(58) Field of Classification Search
CPC .. B21B 2267/18; B21B 27/021; B21B 39/02; B21B 39/14; B21B 39/34; B21D 17/04; B21H 8/00; B21H 8/02; B21H 9/00; B65H 20/20
USPC ..... 72/196, 197; 492/30–32; 226/76–78, 226/82, 87
See application file for complete search history.

(56) References Cited

U.S. PATENT DOCUMENTS 2,346,163 A * 4/1944 Hiles ..... B41J 11/27 226/76
2,754,581 A 7/1956 Thomas
2,782,487 A * 2/1957 Properzi ..... B22F 9/04 72/186
3,613,427 A * 10/1971 Haddon ..... B21D 5/08 72/212
4,047,417 A 9/1977 Oser et al.
4,074,556 A * 2/1978 Takeda ..... B21D 43/08 72/191
4,233,833 A 11/1980 Balinski
5,090,225 A * 2/1992 Schimion ..... B21B 37/32 72/201
5,395,028 A * 3/1995 Ishii ..... H01J 9/142 226/76
8,033,973 B1 * 10/2011 Evans ..... B26D 7/06 226/190
8,047,041 B2 * 11/2011 Hermann ..... B21B 1/0805 72/167
2007/0248793 A1 * 10/2007 Herb ..... B21B 27/00 428/122

FOREIGN PATENT DOCUMENTS

DE 198 18 234 A1 10/1999
EP 0 040 316 A1 11/1981
EP 1 847 340 A1 10/2007

OTHER PUBLICATIONS

German Search Report, dated Oct. 19, 2011, 5 pages total.
European Search Report, dated Jun. 20, 2012, 6 pages total.

* cited by examiner

*Primary Examiner* — Shelley Self
*Assistant Examiner* — Pradeep C Battula
(74) *Attorney, Agent, or Firm* — Crowell & Moring LLP

(57) ABSTRACT

A roller forming device and method for forming a material provided with geometric elements, in particular holes, is disclosed. The device has at least one forming roller and at least one counter roller, wherein a roll gap is configured between the forming roller and the counter roller for carrying through the material. The forming roller has a molding structure on its cylindrical surface, which molds the material when the material runs through the roll gap. The forming roller has carrier elements for an engagement with the geometric elements of the material running through the roll gap.

20 Claims, 1 Drawing Sheet

ROLLER FORMING DEVICE FOR FORMING A LINEAR METAL MATERIAL

This application claims the priority of German Patent Document No. 10 2011 005 401.4, filed Mar. 11, 2011, the disclosure of which is expressly incorporated by reference herein.

BACKGROUND AND SUMMARY OF THE INVENTION

The invention relates to a roller forming device for forming or marking a material provided with geometric elements, in particular holes. This type of roller forming device is designed with at least one forming roller and at least one counter element, in particular a counter roller or a counter table, wherein a gap roll is configured between the forming roller and the counter element for carrying through the material, and wherein the forming roller has a molding structure on its cylindrical surface, which molds the material when the material runs through the roll gap.

According to the prior art, installation rails are typically fabricated in the following process sequence: 1. Straightening of the strip in a straightening machine; 2. Punching geometric elements designed as holes and, if applicable, introducing additional geometric elements such as impressions, pockets, etc., which must have a defined position with respect to the hole pattern, on a mechanical or hydraulic sheet metal forming press; 3. Roll profiling of the perforated strip into a rail on a roll profiling unit; and 4. Cutting the rails to the desired length on a revolving separator.

In the case of this process sequence, the additional geometric elements generated by the sheet metal forming press run through the downstream roll profiling unit. Under some circumstances, this may result in the additional geometric elements being deformed by the subsequent forming operation on the roll profiling unit. In addition, this process chain may restrict the geometric freedom for the additional geometric elements to be introduced, because the additional geometric elements require appropriate clearances in the subsequent sets of rollers on the roll profiling unit for unobstructed passage, which is not always possible.

It is also known to roll structures onto a strip material.

The object of the invention is disclosing a roller forming device for forming an elongate metal material, which provides an especially large degree of geometric freedom and which permits geometric elements such as impressions, pockets, etc., to be precisely formed in an especially simple and reliable manner.

A roller forming device according to the invention for forming or marking a material provided with geometric elements is characterized in that the forming roller has carrier elements for an engagement with the geometric elements, in particular for an engagement in the geometric elements of the material running through the roll gap.

A first basic idea of the invention may be seen as no longer generating the additional geometric elements by means of the sheet metal forming press, but introducing these through a rolling process, which can be carried out on a roll profiling unit downstream from the sheet metal forming press. In particular, this procedure makes it possible to introduce the additional geometric elements only after the forming steps, which would produce a deformation of these elements, and thereby enables the additional geometric elements to be formed especially precisely and with an especially high level of geometric freedom.

The invention further recognizes that an introduction of the additional geometric elements through a driven forming roller running at a constant speed of rotation could be associated with an unsatisfactory result under some circumstances. In the case of known forming devices, a fluctuating elongation and the resulting deviation in the desired rail length is often corrected on the press by adapting the feed rate, which can produce fluctuations in the spacing of the holes from one another. If a constant speed of rotation were to be used in this case, then the fluctuations in the spacing of the holes would produce an undesired offset of the additional geometric elements from the holes.

In order to overcome this potential disadvantage, the invention teaches a non-driven forming roller, i.e., a forming roller that is not provided with a drive, that has carrier elements, which may engage on the first geometric elements, i.e., in particular the holes, so that the forming roller is carried along by the holes in the metal material. Through contact between the carrier element and the edge of the respective hole trailing in the direction of rolling, the carrier elements bring about a rotation of the entire forming roller in accordance with the throughput speed of the material. A mechanical synchronization of the forming roller with the previous introduced hole pattern is hereby realized in an especially simple manner, which reliably guarantees a defined position of the to-be-introduced additional geometric element with the edge of the hole without requiring involved measuring and control technology.

According to the invention, several rollers designed according to the invention may be provided, each of which may then cooperate with a counter roller. According to the invention, the material may be in particular a metallic material, a flat material and/or a strip material, preferably a sheet metal strip. The carrier elements are expediently designed to be peg-shaped.

The roller forming device according to the invention is preferably used for forming a material provided with a plurality of identical geometric elements. The geometric elements are preferably arranged at least approximately equidistantly on the material. The geometric elements may preferably be holes, in particular elongated holes, which extend in the direction of rolling. The geometric elements, however, may also be, for example, raised tabs, lateral recesses or notches, sharp-edge pockets or folds. The invention may advantageously be used in every application in which a subsequent introduction of additional geometric elements that are not freely positionable in a linear material is required where a preceding process step already introduced first geometric elements on which the forming roller according to the invention may catch and synchronize via the carrier elements. According to the invention, the carrier elements are provided in addition to the molding structure. According to the invention, the material provided with the first geometric elements is conveyed to the roller forming device, where it is then provided with the additional geometric elements by the molding structure.

In particular with respect to geometric freedom, it is advantageous that the carrier elements are disposed on the cylindrical surface of the forming roller. It is hereby possible to form additional geometric elements with the forming roller also in the areas which are located between the first geometric elements.

In addition, according to the invention it may be provided that the counter roller has at least one recess for the carrier elements. A reliable operation is also possible hereby even in the case of especially long carrier elements.

A further preferred embodiment of the invention is that the counter roller is mechanically coupled with the forming roller so that a rotation of the forming roller produces a rotation of the counter roller. This type of coupling may be realized, for example, via gear wheels, which are attached on the face side on both rollers.

Moreover, it may be advantageous that the counter roller have a molding structure on its cylindrical surface, which molds the material when the material runs through the roll gap. According to this embodiment, geometric elements may be introduced on the material from both sides thereby further increasing the geometric freedom.

It is especially preferred that the forming roller have at least one run-through angular position, in which the forming roller is spaced apart from the material running through the roll gap, in particular on the molding structure and on the carrier elements of the forming roller. In this run-through angular position, the forming roller is not in contact with the material passing through on its molding structure or on its carrier elements. This type of embodiment of the forming roller makes it possible to stop the roller rotation temporarily or at least slow it down, while the material continues to be moved through the roll gap at a continuous feed rate. As a result, the roller forming device according to the invention may be used in an advantageous manner also in the case of materials in which the spacing of the first geometric elements, i.e., the hole spacing in particular, varies with the time. This is because, for example, a temporarily greater spacing can then be compensated for by a temporarily longer stop of the roller rotation at the run-through angular position, for example. The invention thereby permits an especially high level of precision in the forming process even with varying hole spacing, because it always guarantees a defined position of the to-be-introduced geometric element with an edge of the hole through the intermittently reduced speed of rotation of the forming roller even in the case of fluctuations in the hole spacing. A run-through angular position in which the forming roller is spaced apart from the material running through the roll gap may be made available, for example, in that the carrier elements are smaller in terms of their dimension in the direction of rolling than the hole length. In this case, a run-through of the material relative to the roller may then be possible if the carrier element is situated in the hole, i.e., in the time interval in which the carrier element in the hole moves through the hole. The run-through angular position may also be realized, however, by a sufficiently great angular distance from the adjacent projections on the cylindrical surface of the forming roller.

It is also advantageous that a brake is provided for braking the forming roller. Such a brake may guarantee, for example, that, after pulling a carrier element out of a hole and/or reaching the run-through angular position, the forming roller brakes instead of continuing to rotate unabated due to its inertia so that an uncontrolled striking of the subsequent carrier element in the hole and/or an undesired premature engagement of the subsequent molding structure may be prevented, for example.

Another preferred embodiment of the invention is that at least one of the carrier elements has a friction reducer on its tip for preventing friction between the carrier element and the material. The friction reducer may have, for example, at least one sliding element or at least one roller. This further development has recognized that under some circumstances there is a risk that the material will get scratched by an edge of the peg-shaped carrier elements, and in particular specifically when the forming roller stops abruptly after pulling the carrier element out of the hole, e.g., because of a brake being applied strongly. The friction reducer is able to guarantee that the linear material is able to run through in this roller position as much as possible without any damage.

It is especially preferred that the forming roller is designed to be multi-piece with at least one first roller part on which at least one portion of the molding structure is disposed, and with at least one second roller part on which at least one portion of the carrier elements is disposed, wherein the first roller part and the second roller part can be rotated relative to one another. For example, it is possible to hereby adjust the position of the additional geometric elements formed by the forming roller with respect to the hole pattern. Therefore, according to the invention, both roller parts are able to be rotated around the axis of rotation of the forming roller relative to one another. The two roller parts may in particular be designed to be disk-shaped. The forming roller may also have more than two roller parts that are rotatable relative to one another.

The invention also relates to an apparatus for forming a material, having a device, in particular a press, for introducing geometric elements in the material, and a roller forming device according to the invention for forming the material provided with the geometric elements. Because the geometric elements are preferably holes, the press may be a stamping press in particular. According to the invention, the roller forming device is downstream from the stamping press in terms of the process. The roller forming device may also have additional forming rollers, in particular bending rollers, and be a part of a roll profiling unit. The apparatus according to the invention is preferably used for producing installation rails. Since, according to the invention, the dimensioning of the roller forming device, in particular its forming roller, may depend upon the dimensioning of the material to be formed, the invention may also include a forming arrangement made of a material provided with geometric elements according to the invention and the roller forming device according to the invention for forming the material provided with the geometric elements.

The invention will be explained in greater detail in the following on the basis of preferred exemplary embodiments, which are depicted schematically in the figures.

DETAILED DESCRIPTION OF THE DRAWINGS

Figure 1:
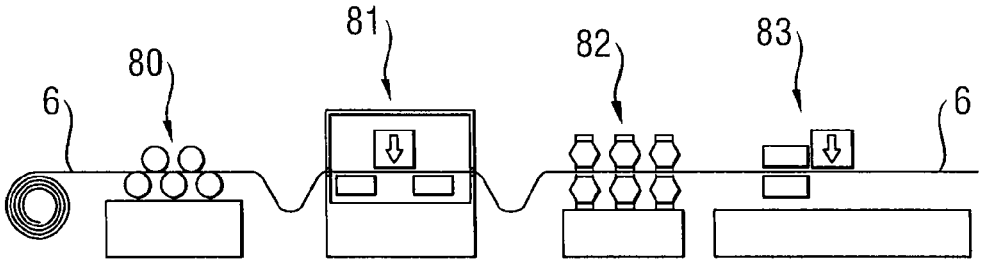
FIG. 1 illustrates an apparatus according to the invention for forming a material, which features a roller forming device according to the invention.

FIG. 1 depicts an apparatus according to the invention for forming a linear material 6. The apparatus has a straightening machine 80, a press 81 for introducing a plurality of the same kind of geometric elements 7, in particular holes, in the material 6, a roller forming device 82 according to the invention as well as a separator 83 for cutting the material 6 to length. The straightening machine 80, the press 81, the roller forming device 82 and the separator 83 are disposed in this sequence consecutively in terms of the process and are run through in this sequence by the material 6.

Figure 2:
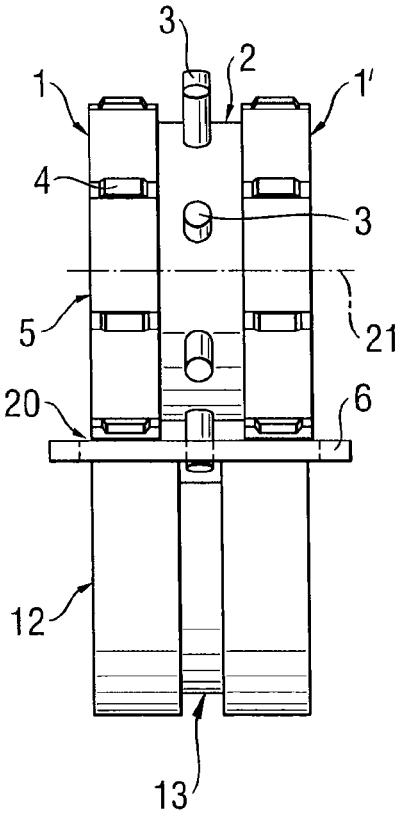
FIG. 2 illustrates a roller forming device according to the invention with a view in the direction of rolling.
Figure 3:
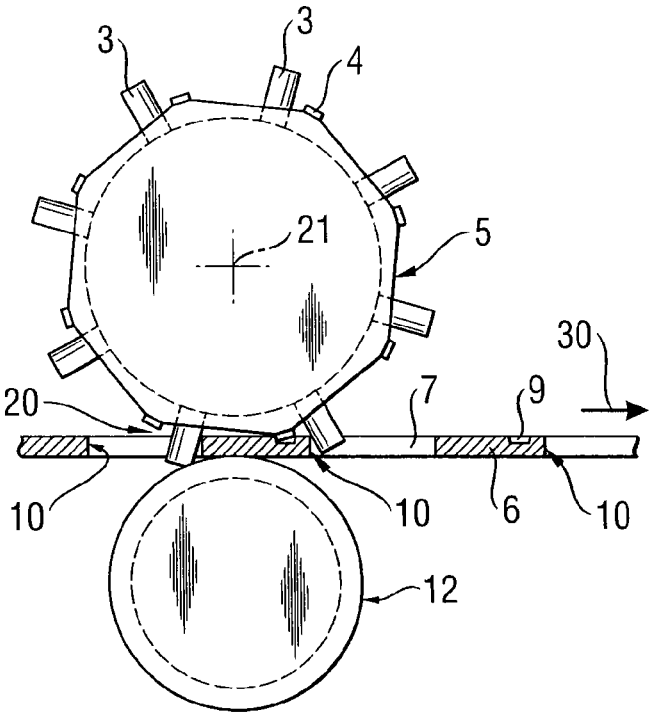
FIG. 3 shows the roller forming device according to the invention from FIG. 2 with a view perpendicular to the direction of rolling.

A roller forming device according to the invention, for example, for use in an apparatus according to FIG. 1 is shown in FIGS. 2 and 3, wherein along with the depicted rollers, the roller forming device may have additional rollers, in particular bending rollers.

The roller forming device depicted in FIGS. 2 and 3 features a forming roller 5, which is rotatable around an axis of rotation 21. Moreover, the roller forming device features a counter roller 12, which corresponds to the forming roller 5 for the build-up of the required forming pressure, and which is rotatable around an axis of rotation that runs parallel to the axis of rotation 21 of the forming roller. A roll gap 20, through which the linear material 6 is guided, is formed between the forming roller 5 and the counter roller 12.

The forming roller 5 is designed to be three-part and has two disk-shaped first roller parts 1, 1' as well as disk-shaped second roller part 2 disposed between the roller parts 1, 1'. A molding structure 4 made up of a plurality of projections in the depicted exemplary embodiment is provided on the cylindrical surface of the first roller parts 1, 1'. A plurality of peg-shaped carrier elements 3 distributed equidistantly over the circumference of the forming roller 5 are disposed on the cylindrical surface of the second roller part 2. The counter roller 12 has an annular groove-shaped recess 13 in its cylindrical surface, which corresponds with the carrier elements 3.

As FIG. 3 shows in particular, carrier elements 3 of the forming roller 5 engage in the region of the roll gap 20 in geometric elements 7 of the linear material 6 that are configured as holes. If the material 6 is now moved through the roll gap 20 in the direction of rolling 30, then the edges 10 of the holes 7 trailing in the direction of rolling 30 carry along the carrier elements 3, thereby putting the forming roller 5 into a rotation around the axis of rotation 21 that is synchronized with the hole pattern. In the course of this rotation, the molding structure 4 situated on the forming roller 5 introduces the desired additional geometric elements 9 at a defined and constant position relative to the edge 10 of the hole 7 trailing in the direction of rolling.

The forming roller 5 in this case is designed such that, with certain run-through angular positions related to the axis of rotational 21, there is no contact between the forming roller 5 and the linear material 6 so that the rotation of the forming roller 5 around the axis of rotation 21 may become intermittently slower or stop, while the material continues to run in the direction of rolling 30. The slowed-down or stopped rotation makes it possible, on the one hand, to balance out any possible fluctuations in the spacing of the geometric elements 7 that are configured as holes, and, on the other hand, to bridge the thickness of the carrier elements 3 that is less in comparison to the hole length.

The individual roller parts 1, 1', 2 are configured to be rotatable around the axis of rotation 21 against one another so that the angular position of the molding structure 4 relative to the carrier elements 3 and therefore the position of the second geometric elements 9 formed by the forming roller 5 are variable from the first geometric elements 7 that are configured as holes.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A roller forming device, comprising:

a forming roller; and a counter element;

wherein a roll gap is defined between the forming roller and the counter element;

wherein the forming roller has a molding structure on a cylindrical surface;

and wherein the forming roller has a plurality of carrier elements, wherein the carrier elements are engageable with geometric elements of a material running through the roll gap.

2. The roller forming device according claim 1, wherein the carrier elements are disposed on an outer cylindrical surface of the forming roller.

3. The roller forming device according to claim 1, wherein the counter element defines a recess and wherein the carrier elements are positionable within the recess.

4. The roller forming device according to claim 1, wherein the counter element is mechanically coupled with the forming roller such that a rotation of the forming roller produces a rotation of the counter element.

5. The roller forming device according to claim 1, wherein the counter element has a molding structure on a cylindrical surface.

6. The roller forming device according to claim 1, wherein the forming roller has a run-through angular position, wherein in the run-through angular position the carrier elements are not engageable with a material running through the roll gap.

7. The roller forming device according to claim 1, further comprising a brake coupled to the forming roller.

8. The roller forming device according to claim 1, wherein at least one of the carrier elements has a friction reducer and wherein friction between the at least one carrier element and a material running through the roll gap is reduceable by the friction reducer.

9. The roller forming device according to claim 1, wherein the forming roller includes a first roller part on which the molding structure is disposed and a second roller part on which the carrier elements are disposed, and wherein the first roller part and the second roller part are rotatable relative to one another.

10. The roller forming device according to claim 1, wherein the carrier elements extend a first radial distance from the forming roller, wherein the molding structure extends a second radial distance from the forming roller, and wherein the first radial distance is greater than the second radial distance.

11. The roller forming device according to claim 1, wherein the carrier elements are disposed at a center of a width of the forming roller and wherein the molding structure is disposed at an end of the width of the forming roller.

12. The roller forming device according to claim 1, wherein the molding structure is a plurality of rectangularly-shaped projections and wherein the carrier elements are peg-shaped.

13. The roller forming device according to claim 1, in combination with a press, wherein the geometric elements of the material are formable by the press.

14. A method for forming a material, comprising the steps of:

running a material through a gap defined between a forming roller and a counter element, wherein the material includes a plurality of formed geometric elements, and wherein the forming roller includes a molding structure and a plurality of carrier elements;

molding the material by the molding structure of the forming roller when the material is run through the gap between the forming roller and the counter element; and engaging a first one of the plurality of carrier elements with an edge of the material that defines a first one of the plurality of geometric elements when the forming roller is at a first angular position and when the material is run through the gap between the forming roller and the counter element, wherein the edge is at a trailing end of the first one of the plurality of geometric elements with respect to a direction of movement of the material.

15. The method according to claim 14, further comprising the step of disposing a second one of the plurality of carrier elements within a second one of the plurality of geometric elements, without contacting the material, when the forming roller is at a second angular position and when the material is run through the gap between the forming roller and the counter element.

16. The method according to claim 15, further comprising the step of slowing or stopping a rotation of the forming roller when the second one of the plurality of carrier elements is disposed within the second one of the plurality of geometric elements.

17. The method according to claim 14, wherein the carrier elements extend a first radial distance from the forming roller, wherein the molding structure extends a second radial distance from the forming roller, and wherein the first radial distance is greater than the second radial distance.

18. The method according to claim 14, wherein the carrier elements are disposed at a center of a width of the forming roller and wherein the molding structure is disposed at an end of the width of the forming roller.

19. The method according to claim 14, wherein the molding structure is a plurality of rectangularly-shaped projections and wherein the carrier elements are peg-shaped.

20. The method according to claim 14, further comprising the step of sequentially positioning the carrier elements with a recess defined by the counter element.

* * * * *